US005876892A

United States Patent [19]

Fujimori et al.

[11] Patent Number: 5,876,892

[45] Date of Patent: Mar. 2, 1999

[54] ELECTROPHOTOGRAPHIC PHOTORECEPTOR WITH POLYCARBONATE COPOLYMER AND BUTADIENE

[75] Inventors: Kenichi Fujimori; Yoshitaro Nakayama, both of Yamanashi-ken; Mitsuru Noro, Nirasaki; Tetsuya Sakuma, Yamanashi-ken; Hajime Suzuki, Kofu, all of Japan

[73] Assignees: Shindengen Electric Manufacturing Co., LTD, Tokyo; Yamanashi Electronics Co., LTD., Yamanashi-Ken, both of Japan

[21] Appl. No.: 90,184

[22] Filed: Jun. 4, 1998

[30] Foreign Application Priority Data

Jun. 12, 1997 [JP] Japan ..... 9-170933
May 1, 1998 [JP] Japan ..... 10-137596

[51] Int. Cl.[6] ..... G03G 5/09; G03G 5/04

[52] U.S. Cl. ..... 430/83; 430/59; 430/96

[58] Field of Search ..... 430/59, 83, 96

[56] References Cited

U.S. PATENT DOCUMENTS

| | | | |
|---|---|---|---|
| 5,128,229 | 7/1992 | Katsukawa et al. | 430/83 |
| 5,213,924 | 5/1993 | Sakamoto | 430/58 |
| 5,283,142 | 2/1994 | Mayama et al. | 430/96 |
| 5,294,510 | 3/1994 | Ueda et al. | 430/83 |
| 5,418,099 | 5/1995 | Mayama et al. | 430/96 |
| 5,443,933 | 8/1995 | Fujimori et al. | 430/59 |
| 5,521,041 | 5/1996 | Miyamoto et al. | 430/58 |
| 5,578,406 | 11/1996 | Ojima et al. | 430/83 |
| 5,747,204 | 5/1998 | Anzai et al. | 430/83 |

FOREIGN PATENT DOCUMENTS

| | | |
|---|---|---|
| 4179961 | 6/1992 | Japan . |
| 9120168 | 5/1997 | Japan . |
| 9297413 | 11/1997 | Japan . |

*Primary Examiner*—Roland Martin
*Attorney, Agent, or Firm*—Stevens, Davis, Miller & Mosher, L.L.P.

[57] ABSTRACT

An electrophotographic photoreceptor in which the surface of a photosensitive layer has a small friction coefficient without impairing the excellent electrophotographic characteristics and which has an enhanced oil resistance and does not cause light fatigue, the electrophotographic photoreceptor comprising an electroconductive support having formed thereon a photosensitive layer comprising at least a charge-generating agent, a charge-transfer agent and a binder resin, wherein the photosensitive layer contains a polycarbonate copolymer comprising a recurring unit represented by the general formula (I) as the binder resin:

(I)

and a butadiene compound represented by the general formula (IV) as the charge-transfer agent:

(IV)

12 Claims, No Drawings

ELECTROPHOTOGRAPHIC PHOTORECEPTOR WITH POLYCARBONATE COPOLYMER AND BUTADIENE

BACKGROUND OF THE INVENTION

This invention relates to an electrophotographic photoreceptor which is used in electrophotographic equipment such as a copying machine, a laser beam printer or the like, particularly to an electrophotographic photoreceptor in which an organic photoconductive material is used.

As a photoconductive material for an electrophotographic photoreceptor, there have been used inorganic materials such as selenium (Se), cadmium sulfide (CdS), zinc oxide (ZnO), amorphous silicon (a-Si) and the like. However, a photoreceptor in which such an inorganic material is used is utilized in such a manner that the photoreceptor is charged in a dark place by, for example, a charged roller and then subjected to image exposure to selectively allow only the charge in the exposed portion to disappear, thereby forming an electrostatic latent image, and the latent image is further visualized with a developer to form an image. The basic characteristics required for such an electrophotographic photoreceptor are (1) it can be charged to a suitable potential in a dark place, (2) it has such a function that surface charges can disappear upon light irradiation, and the like. However, the above-mentioned inorganic materials have various advantages and disadvantages. For example, selenium (Se) satisfies sufficiently the above characteristics (1) and (2) but has disadvantages such as inflexibility and difficulty of processing into a film and attention must be paid to its handling because it is sensitive to heat and mechanical shock. Moreover, amorphous silicon (a-Si) has disadvantages such as severe production conditions and, the production cost thereof becomes high.

Therefore, as the electrophotographic photoreceptor, there has recently been mainly used a function-separated type organic photoreceptor which is formed by laminating a charge-transfer layer comprising a hydrazone compound as a charge-transfer agent or the like to a charge-generating layer in which a phthalocyanine or azo compound known as an organic photoconductive material is used as a charge-generating agent.

As a binder resin for such an organic photoreceptor, there has heretofore been most generally used a bisphenol A type polycarbonate resin.

However, when a photosensitive layer is formed by use of a bisphenol A type polycarbonate resin as the binder resin, there is such a disadvantage that the coating solution for the photosensitive layer is gelling or the like. Therefore, a material for the charge-transfer layer freed of such a disadvantage has been desired.

Moreover, the surface of a photosensitive layer in which the above resin is used has a large friction coefficient, so that when an electrophotographic apparatus is fitted with this electrophotographic photoreceptor and an electrophotographic process is repeated in the equipment, there have been caused such inconveniences that the cleaning blade which is generally used in the cleaning of the toner remaining on the photosensitive layer gets recurved, a noise is generated, and the like.

In addition, this polycarbonate resin is inferior in oil resistance, so that during the maintenance of an electrophotographic apparatus or other workings, fingerprints are left on the surface of the photosensitive layer by erroneously touching the surface in some cases, and in such a case, a crack has often been caused in the portion in which the fingerprint is left to make the electrophotographic photoreceptor unusable.

On the other hand, it has been proposed to use a bisphenol Z type polycarbonate resin as a material for the photosensitive layer of an electrophotographic photoreceptor taking the stability of the coating solution into consideration. However, even when this bisphenol Z type polycarbonate resin is used, there have not been solved such problems as the recurving of a blade that results from a large friction coefficient, noise generation, crack formation, and the like.

No material which can solve all the above problems has been found though polycarbonate resins and polycarbonate copolymers having various structures other than the above-mentioned bisphenol A and Z types have been developed as described in, for example, JP-A-4-179,961.

Another problem is that during the maintenance and exchange of an electrophotographic photoreceptor, the electrophotographic photoreceptor is exposed to room light or the like in some cases, and when the electrophotographic photoreceptor is exposed to light for a long period of time, the charge-transfer agent is deteriorated to result in an elevation of the residual potential of the electrophotographic photoreceptor. Such a circumstance becomes a severe obstacle in the simplification of the maintenance. Therefore, maintenance by a skilled serviceman is required and close attention paid thereto.

SUMMARY OF THE INVENTION

The present inventors have made extensive research for solving the above-mentioned problems and have consequently found that an electrophotographic photoreceptor in which a polycarbonate copolymer having a specific structure is used as a binder resin in a photosensitive layer and a charge-transfer agent having a specific structure is used does not have the above-mentioned problems of the prior art and maintains its excellent electrostatic characteristics over a long period of time, to complete this invention.

An object of this invention is to provide an electrophotographic photoreceptor which has a small friction coefficient of the photosensitive layer surface is improved in oil resistance without impairing the electrophotographic characteristics and has been made free from light fatigue.

Other objects and advantages of this invention will become apparent from the following description.

According to this invention, there is provided an electrophotographic photoreceptor which comprises a photoconductive support having formed thereon a photosensitive layer comprising at least a charge-generating agent, a charge-transfer agent and a binder resin, wherein the above binder resin is composed of a polycarbonate copolymer comprising a recurring unit represented by the general formula (I):

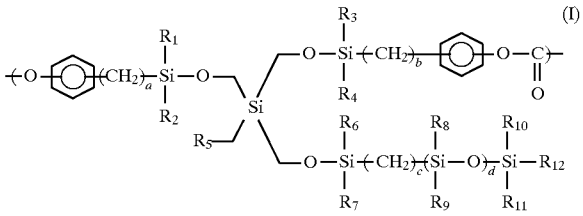

(I)

wherein each of $R_1$ to $R_{12}$ represents independently an alkyl group having 1 to 6 carbon atoms or an aromatic hydrocarbon group having 6 to 12 carbon atoms, each of a to c represents an integer of 2 to 6 and d represents an integer of 0 to 200, and the above charge-transfer agent is composed of a butadiene compound represented by the general formula (IV):

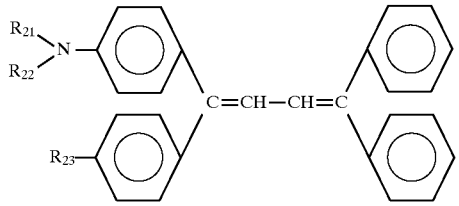

(IV)

wherein each of $R_{21}$ and $R_{22}$ represents independently a substituted or unsubstituted alkyl group having 1 to 6 carbon atoms and $R_{23}$ represents a hydrogen atom or a dialkylamino group.

DETAILED DESCRIPTION OF THE INVENTION

In this invention, since the binder resin in the photosensitive layer is a polycarbonate copolymer comprising a recurring unit consisting of a siloxane structure represented by the general formula (I), the releasability and lubricity are enhanced, and hence, the friction coefficient of the photosensitive layer can be lowered.

Moreover, since the charge-transfer agent is composed of a butadiene compound represented by the general formula (IV), light fatigue is hardly caused.

In this invention, the above polycarbonate copolymer comprising a recurring unit represented by the above general formula (I) may be a polycarbonate copolymer composed of the recurring unit represented by the above general formula (I) and recurring units represented by the following general formulas (II) and (III):

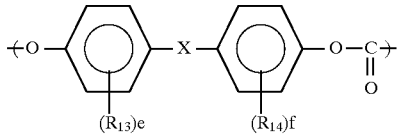

(II)

wherein X represents a single bond, —O—, —CO—, —S—, —SO—, —$SO_2$—, —$CR_{15}R_{16}$— (in which each of $R_{15}$ and $R_{16}$ represents independently a hydrogen atom, a trifluoromethyl group, an alkyl group having 1 to 6 carbon atoms or a substituted or unsubstituted aryl group having 6 to 12 carbon atoms), a 1,1-cycloalkylidene group having 5 to 8 carbon atoms, 9,9-fluorenylidene or an α,ω-alkylene group having 2 to 12 carbon atoms; each of $R_{13}$ and $R_{14}$ represents independently a halogen atom, an alkyl group having 1 to 6 carbon atoms or a substituted or unsubstituted aryl group having 6 to 12 carbon atoms; and each e and f represents independently an integer of 0 to 4.

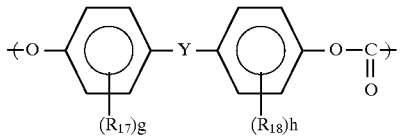

(III)

wherein Y represents a single bond, —O—, —CO—, —S—, —SO—, —$SO_2$—, —$CR_{19}R_{20}$— (in which each of $R_{19}$ and $R_{20}$ represents independently a hydrogen atom, a trifluoromethyl group, an alkyl group having 1 to 6 carbon atoms or a substituted or unsubstituted aryl group having 6 to 12 carbon atoms), a 1,1-cycloalkylidene group having 5 to 8 carbon atoms, an α,ω-alkylene group having 2 to 12 carbon atoms or

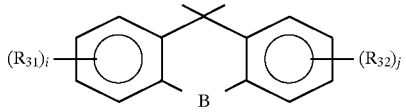

(IX)

(wherein B represents a single bond, —O—, —CO—, —S—, —SO— or —$SO_2$—; each of $R_{31}$ and $R_{32}$ represents independently a halogen atom, an alkyl group having 1 to 12 carbon atoms, a cyclohexyl group, or a substituted or unsubstituted aryl group having 6 to 12 carbon atoms; and each of i and j represents an integer of 0 to 4); each of $R_{17}$ and $R_{18}$ represents independently a halogen atom, an alkyl group having 1 to 12 carbon atoms, a cyclohexyl group, or a substituted or unsubstituted aryl group having 6 to 12 carbon atoms; and when Y is —O—, —CO—, —S—, —SO—, —$SO_2$—, —$CR_{19}R_{20}$— in which $Rl_9$ and $R_{20}$ are as defined above, a 1,1-cycloalkylidene group having 5 to 8 carbon atoms or an α,ω-alkylene group having 2 to 12 carbon atoms, each of g and h represents independently an integer of 1 to 4 and when Y is a single bond, or

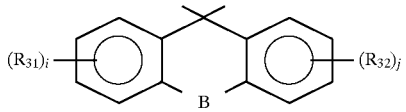

(IX)

in which B, $R_{31}$, $R_{32}$, i and j are defined above, each of g and h represents independently an integer of 0 to 4.

Since the binder resin in the photosensitive layer is composed of a polycarbonate copolymer formed by copolymerizing a monomer of the recurring unit represented by the above general formula (I) with monomers of the recurring units represented by the above general formulas (II) and (III), it follows that the toner-filming resistance is enhanced.

Furthermore, in this invention, the above polycarbonate copolymer composed of the recurring units represented by the above general formulas (I), (II) and (III) may be preferably a polycarbonate copolymer composed of the recurring units represented by the above general formula (I) and the following general formulas (II') and (III'):

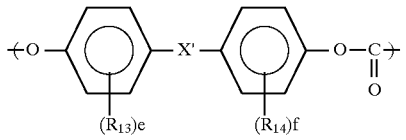

(II')

wherein X' represents —O—, —CO—, —S—, —SO—, —$SO_2$—, —$CR_{15}R_{16}$— (in which each of $R_{15}$ and $R_{16}$ represents independently a hydrogen atom, a trifluoromethyl group, an alkyl group having 1 to 6 carbon atoms or a substituted or unsubstituted aryl group having 6 to 12 carbon atoms), a 1,1-cycloalkylidene group having 5 to 8 carbon atoms or an α,ω-alkylene group having 2 to 12 carbon atoms; each of $R_{13}$ and $R_{14}$ represents independently a halogen atom, an alkyl group having 1 to 6 carbon atoms or a substituted or unsubstituted aryl group having 6 to 12 carbon atoms; and each of e and f represents an integer of 0 to 4.

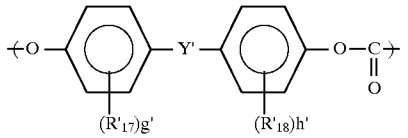

(III')

wherein Y' represents a single bond, —O—, —CO—, —S—, —SO—, —$SO_2$—, —$CR_{19}R_{20}$— (in which each of $Rl_9$ and $R_{20}$ represents independently a hydrogen atom, a trifluoromethyl group, an alkyl group having 1 to 6 carbon atoms or a substituted or unsubstituted aryl group having 6 to 12 carbon atoms), a 1,1-cycloalkylidene group having 5 to 8 carbon atoms or an α,ω-alkylene group having 2 to 12 carbon atoms; each of $R'_{17}$ and $R'_{18}$ represents independently a halogen atom, an alkyl group having 1 to 6 carbon atoms or a substituted or unsubstituted aryl group having 6 to 12 carbon atoms; and when Y' is —O—, —CO—, —S—, —SO—, —$SO_2$—, —$CR_{19}R_{20}$— in which $R_{19}$ and $R_{20}$ are as defined above, a 1,1-cycloalkylidene group having 5 to 8 carbon atoms or an α,ω-alkylene group having 2 to 12 carbon atoms, each of g' and h' represents an integer of 1 to 4 and when Y' is a single bond, each of g' and h' represents independently an integer of 0 to 4.

Moreover, in this invention, the above polycarbonate copolymer composed of the recurring units represented by the above general formulas (I), (II') and (III') may be specifically a polycarbonate copolymer composed of the recurring units represented by the following formulas (Ia), (IIa) and (IIIa) or (IIIb):

Furthermore, in this invention, the above polycarbonate copolymer composed of the recurring units represented by the above general formulas (I), (II) and (III) may be preferably a polycarbonate copolymer composed of the recurring units represented by the above general formulas (I) and (II) and the following general formula (VIII):

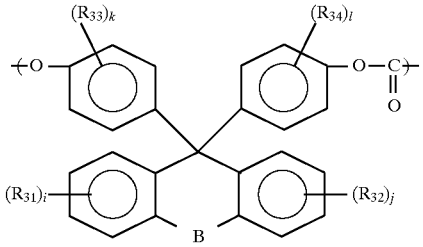

(VIII)

(wherein B represents a single bond, —O—, —CO—, —S—, —SO— or —$SO_2$—; and each of $R_{31}$ to $R_{34}$ represents indepdendently a halogen atom, an alkyl group having 1 to 12 carbon atoms, a cyclohexyl group, or a substituted or unsubstituted aryl group having 6 to 12 carbon atoms; and each of i, j, k and l represents an integer of 0 to 4).

Moreover, in this invention, the above polycarbonate copolymer composed of the recurring units represented by the above general formulas (I), (II) and (VIII) may be specifically a polycarbonate copolymer composed of the recurring units represented by the above formulas (Ia) and (IIa) and the following formula (VIIIa):

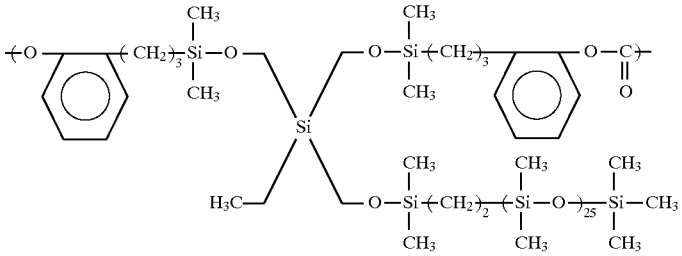

(Ia)

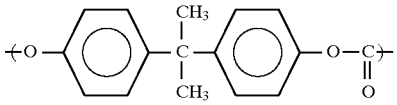

(IIa)

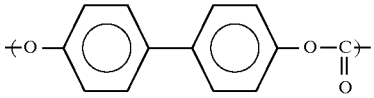

(IIIa)

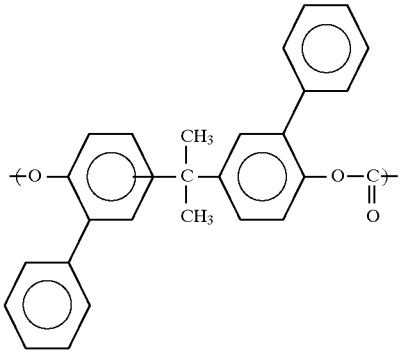

(IIIb)

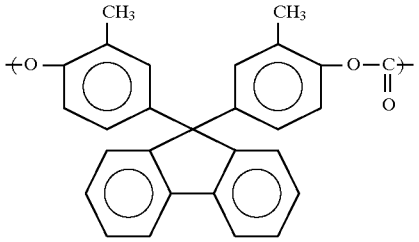

(VIIIa)

Furthermore, the butadiene compound represented by the above general formula (IV) to be used as the charge-transfer agent may be specifically a butadiene compound represented by the following formula (IVa), (IVb) or (IVc):

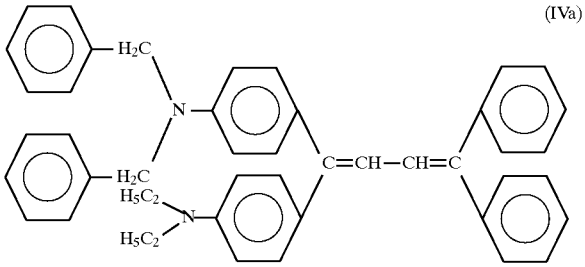

(IVa)

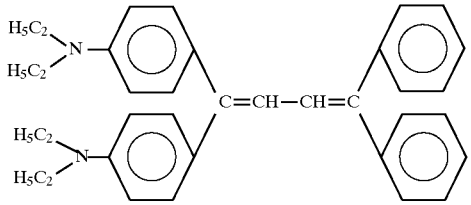

(IVb)

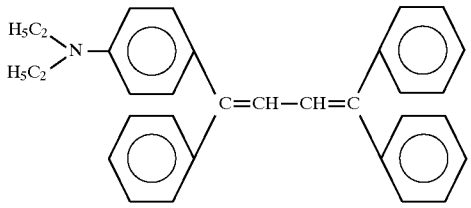

(IVc)

When a butadiene compound represented by the above formula (IVa), (IVb) or (IVc) is used as the charge-transfer agent, the sensitivity of the photosensitive layer becomes high, and hence, said butadiene compound is preferred.

In this invention, the butadiene compound represented by the above general formula (IV) to be used as the charge-transfer agent may be in admixture with a hydrazone compound represented by the following general formula (V):

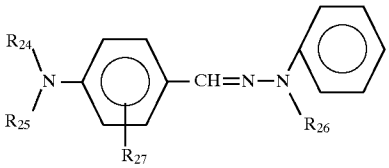

(V)

wherein each of $R_{24}$ and $R_{25}$ represents independently an alkyl group having 1 to 6 carbon atoms, a phenyl group, a benzyl group or a methoxyphenyl group; $R_{26}$ represents an alkyl group having 1 to 6 carbon atoms, a phenyl group, a p-methoxybenzyl group, an ethoxy group, a benzyl group, a methoxyphenyl group, a tolyl group or a naphthyl group; $R_{27}$ represents a hydrogen atom, an alkyl group or an —$OR_{28}$ group in which $R_{28}$ is an alkyl, alkenyl or alkadienyl group having 5 to 10 carbon atoms or an aralkyl group having 7 to 10 carbon atoms.

When the butadiene compound represented by the above general formula (IV) is used in admixture with a hydrazone compound represented by the above general formula (V), such an effect is obtained that even when the sensitivity of the photosensitive layer is relatively low, no light fatigue is caused.

As the above hydrazone compound represented by the above general formula (V), there can be specifically used a compound represented by the following formula (Va):

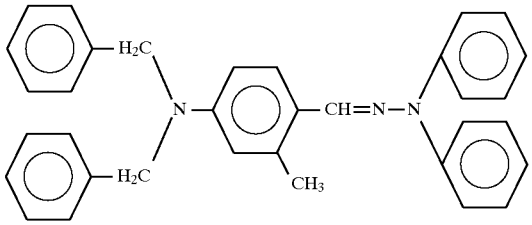

(Va)

This invention can be applied to, for example, a function-separated type electrophotographic photoreceptor in which a charge-generating layer containing at least a charge-generating agent is formed on an electroconductive support and a charge-transfer layer containing at least a charge-transfer agent is further formed thereon. In this case, a photosensitive layer is formed from the charge-generating layer and the charge-transfer layer.

This invention can also be applied to a monolayer type electrophotographic photoreceptor in which a charge-generating agent and a charge-transfer agent are contained in one and the same layer and a reverse laminate type electrophotographic photoreceptor in which a charge-transfer layer and a charge-generating layer are laminated in this order.

The electroconductive support which can be used in this invention can be composed of any material having an electroconductivity without being limited by the kind and shape, which material includes simple metal substances such as aluminum, brass, stainless steel, nickel, chromium, titanium, gold, silver, copper, tin, platinum, molybdenum, indium or the like; processed materials of alloys of these metals; plastic plates or films to which an electroconductivity has been imparted by a treatment such as vapor deposition of or plating with an electroconductive material such as the above-mentioned metal, carbon or the like; electroconductive glass coated with tin oxide, indium oxide or aluminum iodide. Moreover, the shape of the electroconductive support may be any of a drum shape, bar shape, plate shape, sheet shape and belt shape.

As the charge-generating agent which can be used in this invention, disazo pigments and oxytitanium phthalocyanine are preferable in view of congeniality in sensitivity though they are not limited. In addition, there can be used, for example, selenium, selenium-tellurium, selenium-arsenic, amorphous silicon, metal-free phthalocyanine, other metallophthalocyanine pigments, monoazo pigments, trisazo pigments, polyazo pigments, indigo pigments, vat pigments, toluidine pigments, pyrazoline pigments, perylene pigments, quinacridone pigments, polycyclic quinone pigments, pyrylium salts and the like.

These charge-generating agents may be used as a simple substance or may be used as a mixture of two or more thereof for obtaining an appropriate light sensitive wavelength and an appropriate sensitizing action.

In the electrophotographic photoreceptor of this invention, the photosensitive layer comprises a polycarbonate copolymer comprising a recurring unit composed of a siloxane structure represented by the above general formula (I) as a binder resin. Since the polycarbonate copolymer has the above siloxane structure, the friction coefficient of the photosensitive layer can be made small.

The polycarbonate copolymer of this invention can comprise, in addition to the above siloxane structure unit, polycarbonate structure units represented by the above general formulas (II) and (III) as the recurring units. These polycarbonate structure units can be appropriately selected depending upon their characteristics, the ease of synthesis, the use of the resin and the like.

In this case, there can be preferably used a polycarbonate copolymer composed of recurring units represented by the above formulas (I), (II') and (III').

Specifically, there can be used a polycarbonate copolymer composed of recurring units represented by the above formulas (Ia), (IIa) and (IIIa) or (IIIb).

Furthermore, there can be preferably used a polycarbonate copolymer composed of recurring units represented by the above formulas (I), (II) and (VIII).

Specifically, there can be used a polycarbonate copolymer composed of recurring units represented by the above formulas (Ia), (IIa) and (VIIIa).

When the polycarbonate copolymer has at least two kinds of recurring units, the content of the recurring unit represented by the above general formula (I) is preferably 0.0001 or more in terms of the ratio of the number of moles of the recurring unit represented by the general formula (I) to the number of moles of all the recurring units (referred to hereinafter as the molar ratio). When the content of the recurring unit represented by the general formula (I) is less than 0.0001, the effect of enhancing the toner-filming resistance is not sufficiently exerted.

Furthermore, when the above-mentioned polycarbonate copolymer has a reduced viscosity ($\eta_{sp}/C$) of 0.70 dl/g or more as measured in methylene chloride as a solvent at a concentration of 0.5 g/dl at 20° C., the hardness of the photosensitive layer formed becomes high, and hence, said polycarbonate copolymer is preferred.

When the photosensitive layer is of the laminate type or the reverse laminate type, the binder resin of this invention may be used in any one or both of the charge-generating layer and the charge-transfer layer; however, the binder resin is preferably contained in the outermost surface layer in view of its characteristics because the desired characteristics are sufficiently exerted thereby.

On the other hand, in the electrophotographic photoreceptor of this invention, other binder resins than the above-mentioned specific polycarbonate copolymer can also be contained in the photosensitive layer.

As the binder resin which can be used for forming the photosensitive layer, there are mentioned photosetting resins such as polycarbonate resin, styrene resin, acrylic resin, styrene-acrylic resin, ethylene-vinyl acetate resin, polypropylene resin, vinyl chloride resin, chlorinated polyether, vinyl chloride-vinyl acetate resin, polyester resin, furan resin, nitrile resin, alkyd resin, polyacetal resin, polymethylpentene resin, polyamide resin, polyurethane resin, epoxy resin, polyallylate resin, diallylate resin, polysulfone resin, polyethersulfone resin, polyallylsulfone resin, silicone resin, ketone resin, polyvinyl butyral resin, polyether resin, phenol resin, EVA (ethylene-vinyl acetate copolymer) resin, ACS (acrylonitrile•echlorinated polyethyleneestyrene) resin, ABS (acrylonitrile•butadiene•styrene) resin, epoxy allylate resin and the like. These can be used alone or in admixture of two or more. A mixture of the resins having different molecular weights is preferably used because the hardness and friction resistance can be improved thereby.

The electrophotographic photoreceptor of this invention comprises a butadiene compound represented by the above general formula (IV) as the charge-transfer agent in the photosensitive layer.

In this case, it is particularly effective to use 1-p-dibenzylaminophenyl-1-p-diethylaminophenyl-4,4-diphenyl-1,3-butadiene represented by the above formula (IVa), 1,1-bis(p-diethylaminophenyl)-4,4-diphenyl-1,3-butadiene represented by the above formula (IVb) or 1-p-diethylaminophenyl-4,4-diphenyl-1,3-butadiene represented by the above formula (IVc) as the above-mentioned butadiene compound of the general formula (IV) because no light fatigue is caused.

Moreover, a hydrazone compound represented by the above general formula (V) can be contained together with the above butadiene compound as the charge-transfer agent.

As said hydrazone compound, o-methyl-p-dibenzylaminobenzaldehyde•diphenylhydrazone represented by the above formula (Va) can be used.

Furthermore, to the photosensitive layer of the electrophotographic photoreceptor of this invention can be added other charge-transfer agents. In this case, the sensitivity of the photosensitive layer can be enhanced and the residual potential can be lowered, so that the characteristics of the electrophotographic photoreceptor of this invention can be improved.

As the charge-transfer agents which can be added for the improvement of the characteristics, there can be used electroconductive high molecular weight compounds such as polyvinylcarbazole, halogenated polyvinylcarbazole, polyvinylpyrene, polyvinylindoloquinoxaline, polyvinylbenzothiophene, polyvinylanthracene, polyvinylacridine, polyvinylpyrazoline, polyacetylene, polythiophene, polypyrrole, polyphenylene, polyphenylenevinylene, polyisothianaphthene, polyaniline, polydiacetylene, polyheptadiene, polypyridinediyl, polyquinoline, polyphenylene sulfide, polypherocenylene, polyperinaphthylene, polyphthalocyanine and the like.

Furthermore, as a low molecular weight compound, there can be added as the charge-transfer agent, trinitrofluorenone, tetracyanoethylene, tetracyanoquinodimethane, quinone, diphenoquinone, naphthoquinone, anthraquinone, derivatives of them and the like; polycyclic aromatic compounds such as anthracene, pyrene, phenanthrene and the like; nitrogen-containing heterocyclic compounds such as indole, carbazole, imidazole and the like; fluorenone; fluorene; oxadiazole; oxazole; pyrazoline; triphenylmethane; triphenylamine; enamine; stilbene; other butadienes than mentioned above; other hydrazone compounds than mentioned above; and the like.

In addition, as a charge-transfer agent for the same purpose, there can be added solid polyelectrolytes formed by doping high molecular weight compounds such as polyethylene oxide, polypropylene oxide, polyacrylonitrile, polymethacrylic acid and the like with a metal ion such as Li (lithium) ion or the like; and the like.

Moreover, as a charge-transfer agent for the same purpose, there can also be used organic charge-transfer complexes composed of an electron donating material, a representative of which is tetrathiafulvalene-tetracyanoquinodimethane, and an electron accepting material; and the like.

Incidentally, when the above-mentioned charge-transfer agents are added alone or even when they are added in admixture of two or more, the desired photoreceptor characteristics can be obtained.

The electrophotographic photoreceptor of this invention preferably contains an antioxidant or an ultraviolet absorber in its photosensitive layer for the purpose of preventing the change of characteristics and cracking from oxidative deterioration of the photoconductive material and binder resin and for enhancing the mechanical strength.

As the antioxidant which can be used in this invention, preferable are monophenols such as 2,6-di-tert-butylphenol, 2,6-di-tert-butyl-4-methoxyphenol, 2-tert-butyl-4-methoxyphenol, 2,4-dimethyl-6-tert-butylphenol, 2,6-di-tert-butyl-4-methylphenol, butylated hydroxyanisole, stearyl-β-(3,5-di-tert-butyl-4-hydroxyphenyl) propionate, α-tocopherol, β-tocopherol, n-octadecyl-3-(3',5'-di-tert-butyl-4'-hydroxyphenyl) propionate and the like; polyphenols such as 2,2'-methylene-bis(6-tert-butyl-4-methylphenol), 4,4'-butylidenebis(3-methyl-6-tert-butylphenol), 4,4'-thiobis(6-tert-butyl-3-methylphenol), 1,1,3-tris(2-methyl-4-hydroxy-5-tert-butylphenyl)butane, 1,3,5-trimethyl-2,4,6-tris(3,5-di-tert-butyl-4-hydroxybenzyl) benzene, tetrakis[methylene-3-(3,5-di-tert-butyl-4-hydroxyphenyl) propionate]methane and the like; etc., and these can be contained alone or in combination of two or more in the photosensitive layer.

As the ultraviolet absorber, preferable are benzotriazoles such as 2-(5-methyl-2-hydroxphenyl)benzotriazole, 2-[2-hydroxy-3,5-bis(α,α-dimethylbenzyl)-phenyl]-2H-benzotriazole, 2-(3,5-di-tert-butyl-2-hydroxyphenyl) benzotriazole, 2-(3-tert-butyl-5-methyl-2-hydroxyphenyl)-5-chlorobenzotriazole, 2-(3,5-di-tert-butyl-2-hydroxyphenyl)-5-chlorobenzotriazole, 2-(3,5-di-tert-amyl-2-hydroxyphenyl)benzotriazole, 2-(2'-hydroxy-5'-octylphenyl)benzotriazole and the like; and salicylates such as phenyl salicylate, p-tert-butylphenyl salicylate, p-octylphenyl salicylate and the like, and these can be contained alone or in combination of two or more in the photosensitive layer.

Moreover, the antioxidant and the ultraviolet absorber can be simultaneously added. The addition of them may be effected to any layer as far as the layer is in the photosensitive layer; however, it is preferable to add them to the outermost surface layer, particularly the charge-transfer layer.

Incidentally, the antioxidant is preferably added in an amount of 3 to 20% by weight based on the weight of the binder resin and the ultraviolet absorber is preferably added in an amount of 3 to 30% by weight based on the weight of the binder resin. Furthermore, when both the antioxidant and the ultraviolet absorber are added, the amount of both components added is preferably 5 to 40% by weight based on the weight of the binder resin.

In addition to the above-mentioned antioxidant and ultraviolet absorber, there can be added a light stabilizer such as a hindered amine, a hindered phenol compound or the like; an antiaging agent such as a diphenylamine compound or the like; a surface active agent; or the like.

As a method of forming the photosensitive layer, it is typical to disperse or dissolve the given photosensitive material together with the given binder resin in a solvent to prepare a coating solution and then coating the same on the given substrate.

As the coating method, there can be effected dip coating, curtain flow coating, bar coating, roll coating, ring coating, spin coating, spray coating or the like depending upon the shape of the substrate and the state of the coating solution.

Furthermore, the charge-generating layer can be formed by a vacuum deposition method.

The solvent which is used in the coating solution includes alcohols such as methanol, ethanol, n-propanol, i-propanol, butanol and the like; saturated aliphatic hydrocarbons such as pentane, hexane, heptane, octane, cyalohexane, cycloheptane and the like; aromatic hydrocarbons such as toluene, xylene and the like; chlorinated hydrocarbons such as dichloromethane, dichloroethane, chloroform, chlorobenzene and the like; ethers such as dimethyl ether, diethyl ether, tetrahydrofuran (THF), methoxyethanol and the like; ketones such as acetone, methyl ethyl ketone, methyl isobutyl ketone, cyclohexanone and the like; esters such as ethyl formate, propyl formate, methyl acetate, ethyl acetate, propyl acetate, butyl acetate, methyl propionate and the like; N,N-dimethylformamide; dimethyl sulfoxide; and the like. These can be used alone or in admixture of two or more.

In the electrophotographic photoreceptor of this invention, there may be provided an intermediate layer having a bonding function, a barrier function, a support surface defect-covering function or the like between the electroconductive support and the photosensitive layer. As the intermediate layer, there can be used aluminum oxide, a polyethylene resin, an acrylic resin, an epoxy resin, a polycarbonate resin, a polyurethane resin, a vinyl chloride resin, a vinyl acetate resin, a polyvinyl butyral resin, a polyamide resin, a nylon resin and the like. The intermediate layer may be composed of a single resin or a mixture of two or more resins.

An intermediate layer in which a metal compound, a metal oxide, carbon, silica, a resin powder or the like is dispersed in the resin can also be used. Moreover, various pigments, electron accepting materials, electron donating materials and the like can be contained in the intermediate layer for improving the characteristics.

In addition, on the surface of the photosensitive layer, there may be provided a surface-protecting layer by forming an organic thin film of a polyvinyl formal resin, a polycarbonate resin, a fluoroplastic, a polyurethane resin, a silicone resin or the like or a thin film composed of a siloxane structure formed by hydrolysis of a silane coupling agent, and in this case, the durability of the photosensitive layer is enhanced, so that the above surface-protecting layer is preferred. This surface-protecting layer may be provided for enhancing other functions than the enhancement of durability.

DESCRIPTION OF THE PREFERRED EMBODIMENTS

Examples of the electrophotographic photoreceptor of this invention are explained along with Comparative Examples in detail below.

EXAMPLE 1

A charge-generating layer was formed on an aluminum cylindrical drum having a diameter of 30 mm by coating the drum with a dispersion of tytanyl phthalocyanine in a polyvinyl butyral as a binder resin in a thickness of 0.1 μm by dip-coating.

Subsequently, a coating solution was prepared by dissolving in chloroform a polycarbonate copolymer having recurring units represented by the above formulas (Ia), (IIa) and (IIIa) as a binder resin; 1-p-dibenzylaminophenyl-1-p-diethylaminophenyl-4,4-diphenyl-1,3-butadiene represented by the above formula (IVa) as a charge-transfer agent; and 2,6-di-tert-butyl-4-methylphenol represented by the following formula (VI) as an antioxidant at a weight ratio of polycarbonate copolymer/formula (IVa)/formula (VI)=1.0/0.8/0.18:

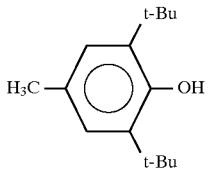

(VI)

In this case, the molar ratio of the recurring units of the polycarbonate copolymer was formula (Ia)/formula (IIa)/formula (IIIa)=0.01/0.85/0.14 and the reduced viscosity was 1.63 dl/g.

This coating solution was coated by dip-coating and thereafter dried at a temperature of 100° C. for one hour to form a charge-transfer layer having a film thickness of 20 μm. In the above-mentioned manner, an electrophotographic photoreceptor was prepared.

EXAMPLE 2

The same procedure as in Example 1 was repeated, except that the polycarbonate copolymer was replaced with a polycarbonate copolymer having a molar ratio of the recurring units, i.e., formula (Ia)/formula (IIa)/formula (IIIa)=0.001/0.85/0.149 and a reduced viscosity of 0.77 dl/g as a binder resin, to prepare an electrophotographic photoreceptor.

EXAMPLE 3

The same procedure as in Example 1 was repeated, except that the charge-transfer agent represented by the above formula (IVa) was replaced with 1,1-bis(p-diethylaminophenyl)-4,4-diphenyl-1,3-butadiene represented by the above formula (IVb), to prepare an electrophotographic photoreceptor.

EXAMPLE 4

The same procedure as in Example 1 was repeated, except that the charge-transfer agent represented by the above formula (IVa) was replaced with 1-p-diethylaminophenyl-4,4-diphenyl-1,3-butadiene represented by the above formula (IVc), to prepare an electrophotographic photoreceptor.

EXAMPLE 5

An electrophotographic photoreceptor was prepared by repeating the same procedure as in Example 1, except that a coating solution was prepared by dissolving in chloroform the same polycarbonate copolymer having the recurring units represented by the above formulas (Ia), (IIa) and (IIIa) as in Example 1, a mixture of 1,1-bis(p-diethylaminophenyl)-4,4-diphenyl-1,3-butadiene represented by the above formula (IVb) and o-methyl-p-dibenzylaminobenzaldehyde•diphenylhydrazone represented by the above formula (Va), in place of the compound of the above formula (IVa), as a charge-transfer agent and the same antioxidant represented by the formula (VI) as in Example 1 at a weight ratio of polycarbonate copolymer/formula (IVb)/formula (Va)/formula (VI)=1.0/0.1/1.0/0.4.

EXAMPLE 6

Oxytitanium phthalocyanine was used as a charge-generating agent and heated in an atmosphere of a pressure of $1.0\times10^{-6}$ mmHg to vapor deposit the same in a thickness of 0.05 μm onto an aluminum cylindrical drum having a diameter of 30 mm, thereby forming a charge-generating layer.

Subsequently, in chloroform were dissolved a polycarbonate copolymer having recurring units represented by the above formulas (Ia), (IIa) and (IIIa) as a binder resin, 1-p-dibenzylaminophenyl-1-p-diethylaminophenyl-4,4-diphenyl-1,3-butadiene represented by the above formula (IVa) as a charge-transfer agent and 2,6-di-tert-butyl-4-methylphenol represented by the above formula (VI) as an antioxidant at a weight ratio of polycarbonate copolymer/formula (IVa)/formula (VI)=1.0/0.8/0.18, to prepare a coating solution.

In this case, the molar ratio of the recurring units of the polycarbonate copolymer was a ratio of formula (Ia)/formula (IIa)/formula (IIIa)=0.01/0.85/0.14 and the reduced viscosity was 1.03 dl/g.

This coating solution was coated by dip-coating and then dried at a temperature of 100° C. for one hour, to form a charge-transfer layer having a thickness of 20 μm. In the above-mentioned manner, an electrophotographic photoreceptor was prepared.

EXAMPLE 7

An electrophotographic photoreceptor was prepared in the same manner as in Example 6, except that the coating solution was prepared by dissolving in chloroform the same polycarbonate copolymer as in Example 6, a mixture of 1,1-bis(p-diethylaminophenyl)-4,4-diphenyl-1,3-butadiene represented by the above formula (IVb) and o-methyl-p-dibenzylaminobenzaldehyde•diphenylhydrazone represented by the above formula (Va), in place of the compound of the above formula (IVa), as a charge-transfer agent and the same antioxidant represented by the formula (VI) as in Example 6 at a weight ratio of polycarbonate copolymer/formula (IVb)/formula (Va)/formula (VI)=1.0/0.1/1.0/0.4.

EXAMPLE 8

A dispersion of oxytitanium phthalocyanine in polyvinyl butyral as a binder resin was coated in a thickness of 0.1 μm by dip-coating on an aluminum cylindrical drum having a diameter of 30 mm, to form a charge-generating layer.

Subsequently, a coating solution was prepared by dissolving in chloroform a polycarbonate copolymer having recurring units represented by the above formulas (Ia), (IIa) and (IIIb) as a binder resin, 1-p-dibenzylaminophenyl-1-p-diethylaminophenyl-4,4-diphenyl-1,3-butadiene represented by the above formula (IVa) as a charge-transfer agent and 2,6-di-tert-butyl-4-methylphenol represented by the above formula (VI) as an antioxidant at a weight ratio of polycarbonate copolymer/formula (IVa)/formula (VI)=1.0/0.8/0.18.

In this case, the molar ratio of the recurring units of the polycarbonate copolymer was a ratio of formulas (Ia)/formula (IIa)/formula (IIIb)=0.01/0.85/0.14 and the reduced viscosity was 1.62 dl/g.

The coating solution was coated by dip-coating and thereafter dried at a temperature of 100° C. for one hour to form a charge-transfer layer having a thickness of 20 μm. In the above-mentioned manner, an electrophotographic photoreceptor was prepared.

EXAMPLE 9

An electrophotographic photoreceptor was prepared by repeating the same procedure as in Example 8, except that in the formation of a charge-transfer layer, the polycarbonate copolymer was replaced with a polycarbonate copolymer having recurring units represented by the above formula (Ia), (IIa) and (IIIb) at a molar ratio of formula (Ia)/formula (IIa)/formula (IIIb)=0.001/0.85/0.149 and having a reduced viscosity of 1.64 dl/g as a binder resin.

EXAMPLE 10

A dispersion of oxytitanium phthalocyanine in polyvinyl butyral as a binder resin was coated in a thickness of 0.1 μm by dip-coating on an aluminum cylindrical drum having a diameter of 30 mm, to form a charge-generating layer.

Subsequently, a coating solution was prepared by dissolving in chloroform a polycarbonate copolymer having recurring units represented by the above formulas (Ia), (IIa) and (VIIIa) as a binder resin, 1-p-dibenzylaminophenyl-1-p-diethylaminophenyl-4,4-diphenyl-1,3-butadiene represented by the above formula (IVa) as a charge-transfer agent and 2,6-di-tert-butyl-4-methylphenol represented by the above formula (VI) as an antioxidant at a weight ratio of polycarbonate copolymer/formula (IVa)/formula (VI)=1.0/0.8/0.18.

In this case, the molar ratio of the recurring units of the polycarbonate copolymer was a ratio of formulas (Ia)/formula (IIa)/formula (VIIIa)=0.01/0.85/0.14 and the reduced viscosity was 1.79 dl/g.

The coating solution was coated by dip-coating and thereafter dried at a temperature of 100° C. for one hour to form a charge-transfer layer having a thickness of 20 μm. In the above-mentioned manner, an electrophotographic photoreceptor was prepared.

EXAMPLE 11

An electrophotographic photoreceptor was prepared by repeating the same procedure as in Example 10, except that in the formation of a charge-transfer layer, the polycarbonate copolymer was replaced with a polycarbonate copolymer having recurring units represented by the above formula (Ia), (IIa) and (VIIIa) at a molar ratio of formula (Ia)/formula (IIa)/formula (VIIIa)=0.001/0.85/0.149 and having a reduced viscosity of 1.83 dl/g as a binder resin.

EXAMPLE 12

The same procedure as in Example 10 was repeated, except that the charge-transfer agent represented by the above formula (IVa) was replaced with 1-p-diethylaminophenyl-4,4-diphenyl-1,3-butadiene represented by the above formula (IVc), to prepare an electrophotographic photoreceptor.

COMPARATIVE EXAMPLE 1

An electrophotographic photoreceptor was prepared by repeating the same procedure as in Example 1, except that in the formation of a charge-transfer layer, the polycarbonate copolymer as a binder resin was replaced with a polycarbonate composed of a recurring unit represented by the above formula (IIa) and having a reduced viscosity of 0.72 dl/g, and in chloroform were dissolved the polycarbonate of the above formula (IIa), the compound of the above formula (IVa) and the compound of the above formula (VI) were dissolved at a weight ratio of formula (IIa)/formula (IVa)/formula (VI)=1.0/0.8/0.18 to prepare a coating solution.

COMPARATIVE EXAMPLE 2

An electrophotographic photoreceptor was prepared by repeating the same procedure as in Comparative Example 1, except that in the formation of a charge-transfer layer, the polycarbonate as a binder resin was replaced with a polycarbonate composed of a recurring unit represented by the above formula (IIIc) and having a reduced viscosity of 0.75 dl/g.

COMPARATIVE EXAMPLE 3

An electrophotographic photoreceptor was prepared by repeating the same procedure as in Comparative Example 1, except that in the formation of a charge-transfer layer, the polycarbonate as a binder resin was replaced with a polycarbonate copolymer composed of recurring units represented by the above formulas (IIa) and (IIIa) and having a molar ratio of the recurring unit of the formula (IIa) to the recurring unit of the formula (IIIa)=0.8/0.2 and a reduced viscosity of 0.76 dl/g.

COMPARATIVE EXAMPLE 4

An electrophotographic photoreceptor was prepared by repeating the same procedure as in Comparative Example 1, except that in the formation of a charge-transfer layer, the polycarbonate as a binder resin was replaced with a polycarbonate copolymer composed of recurring units represented by the above formulas (IIa) and (IIIb) and having a molar ratio of the recurring unit of the formula (IIa) to the recurring unit of the formula (IIIb)=0.9/0.1.

COMPARATIVE EXAMPLE 5

The same procedure as in Example 1 was repeated, except that the charge-transfer agent represented by the above formula (IVa) was replaced with o-methyl-p-dibenzylaminobenzaldehyde•diphenylhydrazone represented by the above formula (Va), to prepare an electrophotographic photoreceptor.

Incidentally, for the evaluation of friction coefficient, a PET (polyethylene terephthalate) film metallized with aluminum having a size of 100 mm×100 mm was coated with one of the photosensitive layers of the Examples and the Comparative Examples to prepare a sheet-like electrophotographic photoreceptor.

Evaluation method

[Determination of electrostatic characteristics]

Using an electrophotographic photoreceptor-evaluating apparatus (manufactured by Yamanashi Electronics Co., Ltd.), electrostatic characteristics including initial surface potential, sensitivity, residual potential, dark decay and the like of the electrophotographic photoreceptors prepared in the Examples and the Comparative Examples were determined. The characteristics were good in all the cases.

[Light fatigue test]

Under the circumstances of normal temperature and normal humidity (24° C., 40% RH), an electrophotographic photoreceptor-evaluating apparatus (manufactured by Yamanashi Electronics Co., Ltd.) was used to charge the cylindrical electrophotographic photoreceptors prepared in the Examples and the Comparative Examples at an applied voltage of −5 KV and then the photoreceptors were exposed to a light having a wavelength of 780 nm at an exposure light quantity of 20 erg/cm$^2$, and the residual potential $V_R$ (−V) at that time was determined.

On the other hand, the above electrophotographic photoreceptors were irradiated with a light from a fluorescent lighting at an illuminance of 800 lux for 10 minutes and thereafter the residual potential $V_{R1}$ (−V) was determined by the above-mentioned electrophotographic photoreceptor-evaluating apparatus. The difference between the residual potentials before and after the irradiation with a light from a fluorescent lighting ($|V_R-V_{R1}|$) was indicated as $\Delta V_R$ (V). The results obtained are shown in Table 1.

[Determination of friction coefficient]

A sheet-like electrophotographic photoreceptor prepared for evaluating friction coefficient was fixed on a plane and static friction coefficient was determined using a friction coefficient determining apparatus (TRIBOGEAR $\mu^s$ TYPE: 94B manufactured by HEIDON). The results obtained are shown in Table 1.

[Printed image test]

The cylindrical electrophotographic photoreceptors prepared in the Examples and Comparative Examples 1 to 4 were negatively charged by a brush-charging system and then mounted in the above-mentioned electrophotographic photoreceptor-evaluating apparatus in which the formation of a printed image is effected by an LED exposure system, a nonmagnetic single-component development system and a blade cleaning system in turn, and 5,000 sheets of A4 size paper were subjected to setting using the apparatus. The printed image after the setting was evaluated. The results obtained are shown in Table 1.

Separately, the cylindrical electrophotographic photoreceptors prepared in the Examples and Comparative Example 5 were subjected to the above-mentioned light fatigue test and thereafter mounted in the above-mentioned electrophotographic photoreceptor-evaluating apparatus, and the setting was conducted after which the printed image was evaluated.

In the judgment, "o " means good and "x" means that printed image failure and the like are seen and there is a problem in practical use. Incidentally, "-" means that the printed image test was not made.

[Evaluation of recurving of blade and generation of noise]

In the setting of 5,000 sheets in the printed image test, whether or not the recurving of blade was seen and whether or not noise of blade was generated were measured. The results obtained are shown in Table 1. In this case, in the judgment, "o" means that no recurving of blade was seen or no noise of blade was generated and "x" means the recurving was seen or the sound was generated.

[Evaluation of generation of crack]

A fingerprint was left on the surface of the above-mentioned electrophotographic photoreceptor and the fingerprint-left portion was allowed to stand under the normal temperature-humidity conditions for 24 hours and then observed as to whether or not a crack was generated. The results obtained are shown in Table 1. In this case, in the judgement, "o" means that no crack was generated and "x" means that a crack was generated.

TABLE 1

| | Friction co-efficient | Light fatigue (V) | Blade Re-curving | Blade Noise | Blade Crack | Printed image 5,000 sheets | Printed image After light fatigue |
|---|---|---|---|---|---|---|---|
| Example 1 | 0.23 | 10 | ○ | ○ | ○ | ○ | ○ |
| Example 2 | 0.28 | 10 | ○ | ○ | ○ | ○ | ○ |
| Example 3 | 0.20 | 3 | ○ | ○ | ○ | ○ | ○ |
| Example 4 | 0.22 | 3 | ○ | ○ | ○ | ○ | ○ |
| Example 5 | 0.23 | 6 | ○ | ○ | ○ | ○ | ○ |
| Example 6 | 0.23 | 10 | ○ | ○ | ○ | ○ | ○ |
| Example 7 | 0.22 | 6 | ○ | ○ | ○ | ○ | ○ |
| Example 8 | 0.20 | 10 | ○ | ○ | ○ | ○ | ○ |
| Example 9 | 0.27 | 10 | ○ | ○ | ○ | ○ | ○ |

TABLE 1-continued

| | Friction co-efficient | Light fatigue (V) | Blade Re-curving | Blade Noise | Blade Crack | Printed image 5,000 sheets | Printed image After light fatigue |
|---|---|---|---|---|---|---|---|
| Example 10 | 0.18 | 3 | ○ | ○ | ○ | ○ | ○ |
| Example 11 | 0.25 | 3 | ○ | ○ | ○ | ○ | ○ |
| Example 12 | 0.18 | 10 | ○ | ○ | ○ | ○ | ○ |
| Comp. Ex. 1 | 0.41 | 10 | x | x | x | x | — |
| Comp. Ex. 2 | 0.41 | 10 | x | x | x | x | — |
| Comp. Ex. 3 | 0.39 | 10 | x | x | x | x | — |
| Comp. Ex. 4 | 0.40 | 10 | x | x | x | x | — |
| Comp. Ex. 5 | 0.23 | 120 | ○ | ○ | ○ | — | x |

Note:
Recurving of blade: ○: Not seen, x: Seen
Noise of blade: ○: Not generated, x: Generated
Crack ○: Not caused, x: Caused
Printed image test: ○: Good, x: Printed image failure are seen and there is a problem in practical use.

As is clear from Table 1, in the case of the electrophotographic photoreceptors of Examples 1 to 12, the friction coefficient was small, no recurving of blade was seen and no noise of blade was generated at all, so that no defect was seen in the printed image after the setting.

Moreover, generation of a crack due to the fingerprint was not found and substantially no light fatigue was seen, so that maintenance can be easily done even by an unskilled serviceman.

In addition, as understood from Examples 1 to 3, good results were obtained even when the composition ratio of the recurring units in the binder resin were changed.

On the other hand, in the case of the electrophotographic photoreceptors of Comparative Examples 1 to 4, the light fatigue was minimal since the butadiene compound to be used in this invention was used. However, since the polycarbonate copolymer to be used in this invention was not used, the friction coefficient was large, recurving of blade was seen and noise of blade was generated, and as a result, there were seen black points on the white ground, white points on the black ground and stripe-like defects which seem to be caused by cleaning failure, on the printed image after the continuous setting. Moreover, during the continuous setting, recurving of blade was seen and noise of blade was generated, so that the electrophotographic photoreceptor-evaluating apparatus had to be often stopped.

In addition, in Comparative Examples 1 to 4, many cracks were caused by the fingerprints that had been left. When the electrophotographic photoreceptors in which cracks were caused were mounted in the electrophotographic photoreceptor-evaluating apparatus and subjected to setting, cracks appeared on the image and the resulting printed matter was unable to be used in practice.

On the other hand, in Comparative Example 5, the polycarbonate copolymer to be used in this invention was used, so that neither recurving nor noise of blade was generated and no crack was caused. However, since the butadiene compound to be used in this invention was not used, the deterioration of the charge-transfer agent was caused in the light fatigue test and black points appeared on the white ground image after the light fatigue and the printed matter was unable to be used in practice.

As stated above, the electrophotographic photoreceptor of this invention is very small in friction coefficient, generates neither recurving nor noise of blade at all and exhibits excellent durability against the fingerprints that had been left, without impairing electrostatic characteristics such as surface potential, sensitivity and the like.

According to this invention, there can be provided electrophotographic photoreceptors which are excellent in electrophotographic characteristics, cleaning properties and oil resistance and by which the maintenance can be simplified.

What is claimed is:

1. An electrophotographic photoreceptor which comprises an electroconductive support having formed thereon a photosensitive layer comprising at least a charge-generating agent, a charge-transfer agent and a binder resin, wherein the photosensitive layer contains a polycarbonate copolymer comprising a recurring unit represented by the general formula (I) as the binder resin:

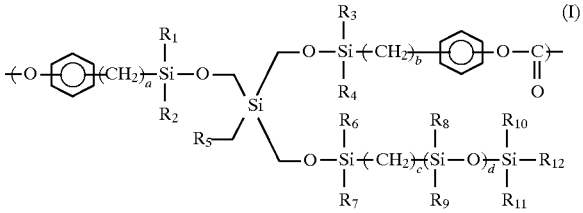

(I)

wherein each of $R_1$ to $R_{12}$ represents independently an alkyl group having 1 to 6 carbon atoms or an aromatic hydrocarbon group having 6 to 12 carbon atoms; each of a to c represents independently an integer of 2 to 6; and d represents an integer of 0 to 200, and a butadiene compound represented by the general formula (IV) as the charge-transfer agent:

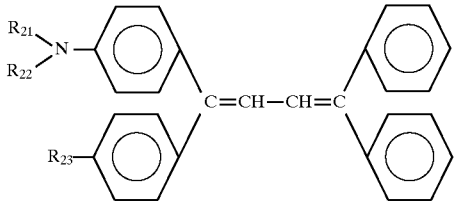

(IV)

wherein each of $R_{21}$, and $R_{22}$ represents independently a substituted or unsubstituted alkyl group having 1 to 6 carbon atoms and $R_{23}$ represents a hydrogen atom or a dialkylamino group.

2. The electrophotographic photoreceptor according to claim 1, wherein the binder resin is a polycarbonate copolymer composed of recurring units represented by the general formulas (I), (II) and (III):

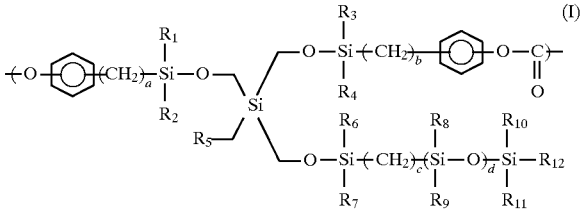

(I)

wherein each of $R_1$ to $R_{12}$ represents independently an alkyl group having 1 to 6 carbon atoms or an aromatic hydrocarbon group having 6 to 12 carbon atoms; each of a to c represents an integer of 2 to 6; and d represents an integer of 0 to 200;

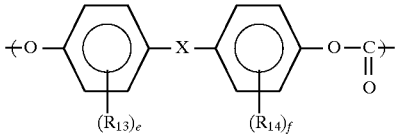

(II)

wherein X represents a single bond, —O—, —CO—, —S—, —SO—, —$SO_2$—, —$CR_{15}R_{16}$— (in which each of $_{15}$ and $R_{16}$ represents independently a hydrogen atom, a trifluoromethyl group, an alkyl group having 1 to 6 carbon atoms or a substituted or unsubstituted aryl group having 6 to 12 carbon atoms), a 1,1-cycloalkylidene group having 5 to 8 carbon atoms, 9,9-fluorenylidene or an α,ω-alkylene group having 2 to 12 carbon atoms; each of $R_{13}$ and $R_{14}$ represents independently a halogen atom, an alkyl group having 1 to 6 carbon atoms or a substituted or unsubstituted aryl group having 6 to 12 carbon atoms; and each of e and f represents an integer of 0 to 4;

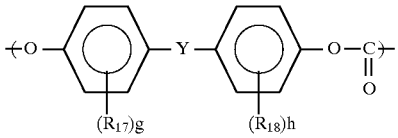

(III)

wherein Y represents a single bond, —O—, —CO—, —S—, —SO—, —$SO_2$—, —$CR_{19}R_{20}$— (in which each of $R_{19}$ and $R_{20}$ represents independently a hydrogen atom, a trifluoromethyl group, an alkyl group having 1 to 6 carbon atoms or a substituted or unsubstituted aryl group having 6 to 12 carbon atoms), a 1,1-cycloalkylidene group having 5 to 8 carbon atoms, an α,ω-alkylene group having 2 to 12 carbon atoms or

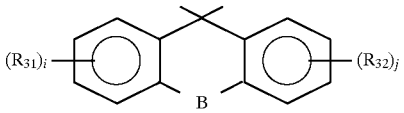

(IX)

(wherein B represents a single bond, —O—, —CO—, —S—, —SO— or —$SO_2$—; each of $R_{31}$, and $R_{32}$ represents independently a halogen atom, an alkyl group having 1 to 12 carbon atoms, a cyclohexyl group, or a substituted or unsubstituted aryl group having 6 to 12 carbon atoms; and each of i and j represents an integer of 0 to 4); each of $R_{17}$ and $R_{18}$ represents independently a halogen atom, an alkyl group having 1 to 12 carbon atoms, a cyclohexyl group, or a substituted or unsubstituted aryl group having 6 to 12 carbon atoms; and when Y is —O—, —CO—, —S—, —SO—, —$SO_2$—, —$CR_{19}R_{20}$— in which $R_{19}$ and $R_{20}$ are as defined above, a 1,1-cycloalkylidene group having 5 to 8 carbon atoms or an α,ω-alkylene group having 2 to 12 carbon atoms, each of g and h represents an integer of 1 to 4 and when Y is a single bond or

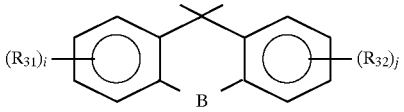

(IX)

in which B, $R_{31}$, $R_{32}$, i and j are defined above, each of g and h represents independently an integer of 0 to 4.

3. The electrophotographic photoreceptor according to claim 2, wherein the binder resin is a polycarbonate copolymer composed of recurring units represented by the general formulas (I), (II') and (III'):

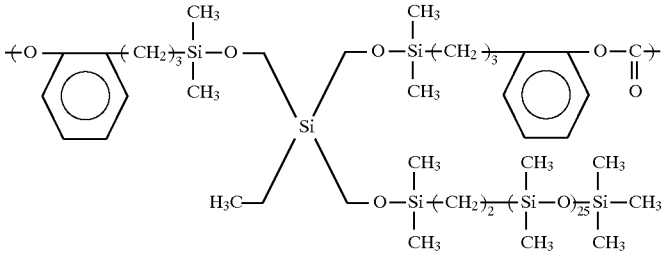

(I)

wherein each of $R_1$ to $R_{12}$ represents independently an alkyl group having 1 to 6 carbon atoms or an aromatic hydrocarbon group having 6 to 12 carbon atoms; each of a to c represents an integer of 2 to 6; and d represents an integer of 0 to 200;

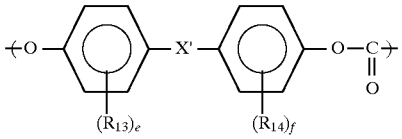

(II')

wherein X' represents —O—, —CO—,—S—, —SO—, —$SO_2$—, —$CR_{15}R_{16}$— (in which each of $R_{15}$ and $R_{16}$ represents independently a hydrogen atom, a trifluoromethyl group, an alkyl group having 1 to 6 carbon atoms or a substituted or unsubstituted aryl group having 6 to 12 carbon atoms), a 1,1-cycloalkylidene group having 5 to 8 carbon atoms or an α,ω-alkylene group having 2 to 12 carbon atoms; each of $R_{13}$ and $R_{14}$ represents independently a halogen atom, an alkyl group having 1 to 6 carbon atoms or a substituted or unsubstituted aryl group having 6 to 12 carbon atoms; and each of e and f represents an integer of 0 to 4;

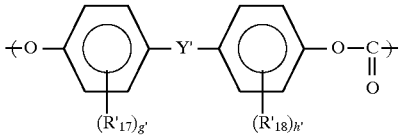

(III')

wherein Y' represents a single bond, —O—, —CO—, —S—, —SO—, —$SO_2$—, —$CR_{19}R_{20}$— (in which each of $R_{19}$ and $R_{20}$ represents independently a hydrogen atom, a trifluoromethyl group, an alkyl group having 1 to 6 carbon atoms or a substituted or unsubstituted aryl group having 6 to 12 carbon atoms), a 1,1-cycloalkylidene group having 5 to 8 carbon atoms or an α,ω-alkylene group having 2 to 12 carbon atoms; each of $R'_{17}$ and $R'_{18}$ represents independently a halogen atom, an alkyl group having 1 to 6 carbon atoms or a substituted or unsubstituted aryl group having 6 to 12 carbon atoms; and when Y' is —O—, —CO—, —S—, —SO—, —$SO_2$—, —$CR_{19}R_{20}$— in which $R_{19}$ and $R_{20}$ are as defined above, a 1,1-cycloalkylidene group having 5 to 8 carbon atoms or an α,ω-alkylene group having 2 to 12 carbon atoms, each of g' and h' represents an integer of 1 to 4 and when Y' is a single bond, each of g' and h' represents independently an integer of 0 to 4.

4. The electrophotographic photoreceptor according to claim 3, wherein the binder resin is a polycarbonate copolymer composed of recurring units represented by the formulas (Ia), (IIa) and (IIIa):

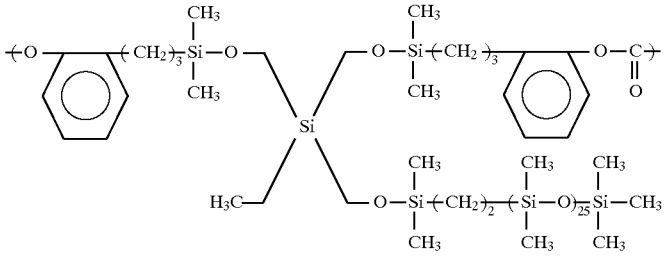

(Ia)

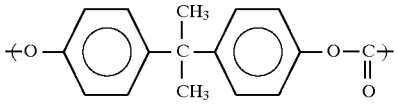

(IIa)

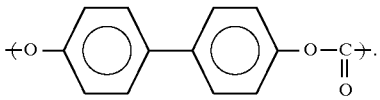

(IIIa)

5. The electrophotographic photoreceptor according to claim 3, wherein the above binder resin is a polycarbonate copolymer composed of recurring units represented by the formulas (Ia), (IIa) and (IIIb):

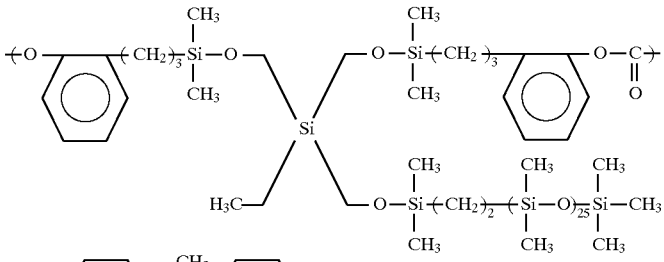

(I)

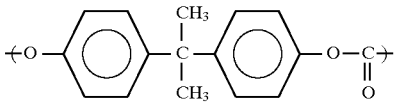

(IIa)

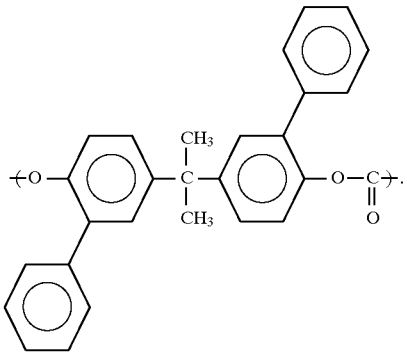

(IIIb)

6. The electrophotographic photoreceptor according to claim 2, wherein the binder resin is a polycarbonate copolymer composed of recurring units represented by the general formulas (I), (II) and (VIII):

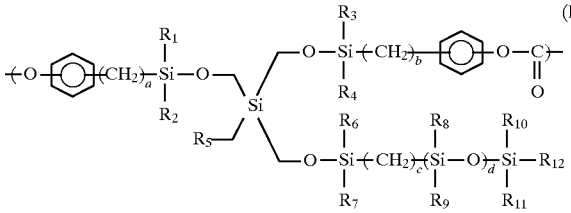

(I)

wherein each of $R_1$ to $R_{12}$ represents independently an alkyl group having 1 to 6 carbon atoms or an aromatic hydrocarbon group having 6 to 12 carbon atoms; each of a to c represents an integer of 2 to 6; and d represents an integer of 0 to 200;

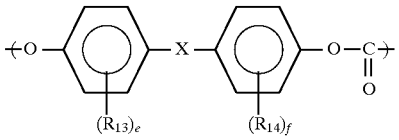

(II)

wherein X represents a single bond, —O—, —CO—, —S—, —SO—, $—SO_2—$, $—CR_{15}R_{16}—$ (in which each of $R_{15}$ and $R_{16}$ represents independently a hydrogen atom, a trifluoromethyl group, an alkyl group having 1 to 6 carbon atoms or a substituted or unsubstituted aryl group having 6 to 12 carbon atoms), a 1,1-cycloalkylidene group having 5 to 8 carbon atoms, 9,9-fluorenylidene or an α,ω-alkylene group having 2 to 12 carbon atoms; each of $R_{13}$ and $R_{14}$ represents independently a halogen atom, an alkyl group having 1 to 6 carbon atoms or a substituted or unsubstituted aryl group having 6 to 12 carbon atoms; and each of e and f represents an integer of 0 to 4;

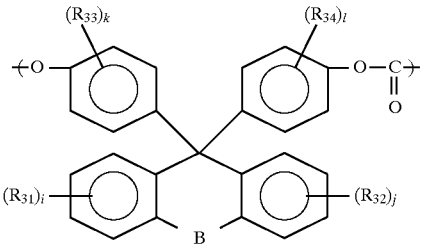

(VIII)

(wherein B represents a single bond, —O—, —CO—, —S—, —SO— or $—SO_2—$; and each of $R_{31}$ to $R_{34}$ represents indepdendently a halogen atom, an alkyl group having 1 to 12 carbon atoms, a cyclohexyl group, or a substituted or unsubstituted aryl group having 6 to 12 carbon atoms; and each of i, j, k and l represents an integer of 0 to 4).

7. The electrophotographic photoreceptor according to claim 6, wherein the above binder resin is a polycarbonate copolymer composed of recurring units represented by the formulas (Ia), (IIa) and (VIIIa):

(Ia)

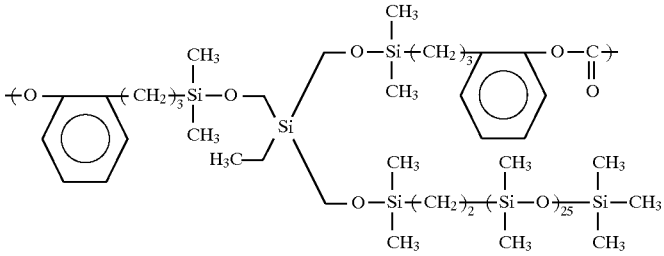

(IIa)

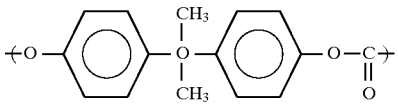

(VIIIa)

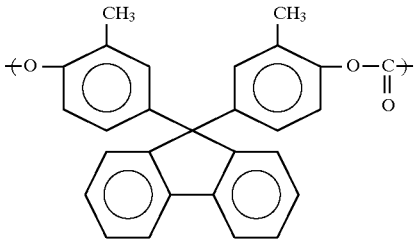

8. The electrophotographic photoreceptor according to claim 1, wherein the charge-transfer agent is a butadiene compound represented by the following formula (IVa):

(IVa)

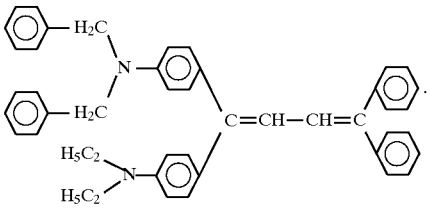

9. The electrophotographic photoreceptor according to claim 1, wherein the charge-transfer agent is a butadiene compound represented by the formula (IVb):

(IVb)

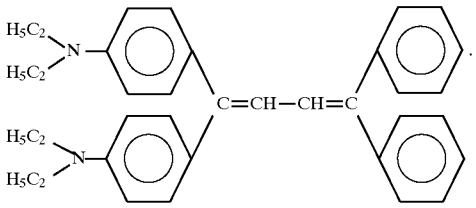

10. The electrophotographic photoreceptor according to claim 1, wherein the charge-transfer agent is a butadiene compound represented by the formula (IVc):

(IVc)

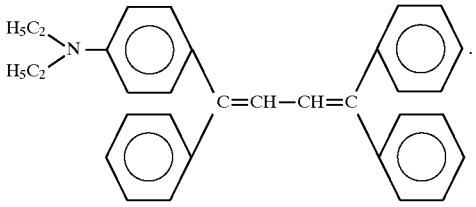

11. The electrophotographic photoreceptor according to claim 1, wherein the charge-transfer agent is a mixture of a butadiene compound represented by the general formula (IV):

(IV)

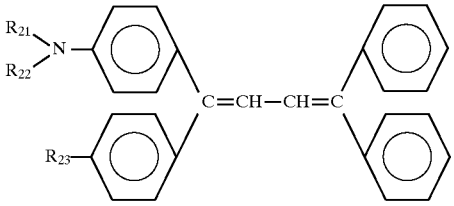

wherein each of $R_{21}$ and $R_{22}$ represents independently a substituted or unsubstituted alkyl group having 1 to 6 carbon atoms and $R_{23}$ represents a hydrogen atom or a dialkylamino group, and a hydrazone compound represented by the general formula (V):

(V)

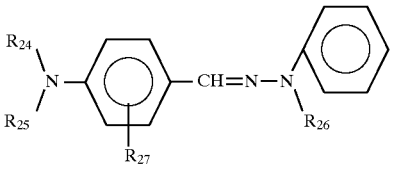

wherein each of $R_{24}$ and $R_{25}$ represents independently an alkyl group having 1 to 6 carbon atoms, a phenyl group, a benzyl group or a methoxyphenyl group; $R_{26}$ represents an alkyl group having 1 to 6 carbon atoms, a phenyl group, a p-methoxybenzyl group, an ethoxy group, a benzyl group, a methoxyphenyl group, a tolyl group or a naphthyl group; and $R_{27}$ represents a hydrogen atom, an alkyl group or a —$OR_{28}$ group in which $R_{28}$ represents an alkyl, alkenyl or alkadienyl group having 5 to 10 carbon atoms or an aralkyl group having 7 to 10 carbon atoms.

12. The electrophotographic photoreceptor according to claim 11, wherein the hydrazone compound is a compound represented by the formula (Va):

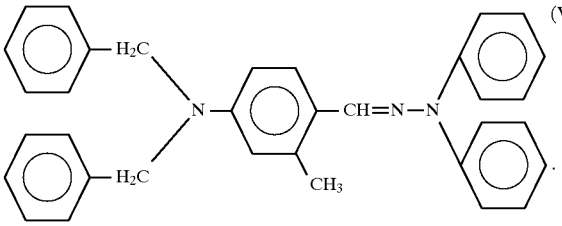
(Va)
* * * * *